US010745918B2

(12) United States Patent
Fringero

(10) Patent No.: US 10,745,918 B2
(45) Date of Patent: Aug. 18, 2020

(54) PROJECTOR SUNSHADE COVER

(71) Applicant: Boaz Fringero, Herzliya (IL)

(72) Inventor: Boaz Fringero, Herzliya (IL)

( * ) Notice: Subject to any disclaimer, the term of this patent is extended or adjusted under 35 U.S.C. 154(b) by 0 days.

(21) Appl. No.: 15/575,366

(22) PCT Filed: May 19, 2016

(86) PCT No.: PCT/IB2016/052932

§ 371 (c)(1),
(2) Date: Nov. 19, 2017

(87) PCT Pub. No.: WO2016/198974

PCT Pub. Date: Dec. 15, 2016

(65) Prior Publication Data

US 2018/0155953 A1 Jun. 7, 2018

Related U.S. Application Data

(60) Provisional application No. 62/163,465, filed on May 19, 2015.

(51) Int. Cl.

| | |
|---|---|
| ***E04F 10/02*** | (2006.01) |
| ***E06B 9/24*** | (2006.01) |
| ***G09F 19/18*** | (2006.01) |
| ***G09F 23/04*** | (2006.01) |
| ***G09F 13/04*** | (2006.01) |
| ***G09F 13/06*** | (2006.01) |
| ***G09F 13/08*** | (2006.01) |
| *A45B 25/18* | (2006.01) |

(52) U.S. Cl.

CPC ..... *E04F 10/02* (2013.01); *E06B 9/24* (2013.01); *G09F 13/04* (2013.01); *G09F 13/06* (2013.01); *G09F 13/08* (2013.01); *G09F 19/18* (2013.01); *G09F 23/04* (2013.01); *A45B 25/18* (2013.01); *A45B 2025/183* (2013.01); *E06B 2009/2405* (2013.01)

(58) Field of Classification Search

CPC ..... G09F 13/06; G09F 13/08; G09F 23/04; E04F 10/02; E06B 2009/2405

USPC ..... 135/33.7, 33.71, 33.2, 115; 40/513, 560, 40/561, 580; 52/204.59; 160/237

See application file for complete search history.

(56) References Cited

U.S. PATENT DOCUMENTS 218,750 A * 8/1879 Jory ..... G09F 13/06 40/580
276,152 A * 4/1883 Barricklo ..... A47L 23/26 428/54

(Continued)

FOREIGN PATENT DOCUMENTS

DE 102014220818 A1 * 4/2016 ..... E06B 9/24
DE 102016013695 A1 * 5/2018 ..... F21V 3/00

(Continued)

*Primary Examiner* — Robert Canfield

(74) *Attorney, Agent, or Firm* — Mark David Torche; Patwrite Law

(57) ABSTRACT

Disclosed herein is a projector sunshade for projecting an image of a logo onto a surface. The projector sunshade includes a UV-treated sheet, a first area on the UV-treated sheet including a shape of the logo, the first area being substantially transparent to light from an illumination source; and a second area surrounding the first area and including a lower transparency to the light relative to the first area.

20 Claims, 8 Drawing Sheets

(56) References Cited

U.S. PATENT DOCUMENTS 320,245 A * 6/1885 Hamm ..... E06B 9/40 160/238
928,774 A * 7/1909 Livergood ..... A45B 25/18 135/33.71
1,879,695 A * 9/1932 Leissner ..... A47H 23/02 112/405
2,152,845 A * 4/1939 Hays ..... G09F 13/26 40/577
2,336,265 A * 12/1943 Lester ..... D06M 15/07 442/131
2,554,204 A * 5/1951 Mueller ..... A45B 11/00 135/19.5
2,563,353 A * 8/1951 Mueller ..... A45B 11/00 135/19.5
2,823,477 A * 2/1958 Willard ..... F21V 1/00 40/554
D195,252 S * 5/1963 Nikolich ..... D25/149
3,308,872 A * 3/1967 Smith ..... A47H 23/04 160/120
3,456,106 A * 7/1969 Gluschkin ..... F21V 1/00 362/97.1
4,263,737 A * 4/1981 Simon ..... G09F 13/08 283/56
4,316,337 A * 2/1982 Da Costa ..... G09F 13/08 40/564
4,817,315 A * 4/1989 Kammerer ..... G09F 13/08 40/441
5,128,850 A * 7/1992 Juodvalkis ..... F21V 3/00 362/224
D339,910 S * 10/1993 Flanagan ..... D11/55
5,682,939 A * 11/1997 Vargo ..... A47H 23/04 160/121.1
5,823,212 A * 10/1998 Allen ..... A45B 25/00 135/16
D415,644 S * 10/1999 Goodwin ..... D6/575
6,223,758 B1 * 5/2001 Feldman ..... A45B 25/02 135/15.1
6,558,022 B2 * 5/2003 Kawahara ..... F21S 10/007 362/257
6,651,720 B1 * 11/2003 DiSilvestro ..... E06B 9/40 160/121.1
6,672,748 B2 * 1/2004 Baldwin ..... G09F 13/00 362/222
7,171,772 B1 * 2/2007 Male ..... G09F 13/04 40/541
9,169,690 B2 * 10/2015 Blair ..... E06B 9/24
9,175,509 B2 * 11/2015 Clarren ..... E06B 9/24
9,744,803 B2 * 8/2017 Walant ..... B44C 1/005
2004/0213007 A1 * 10/2004 Portillo ..... G09F 19/18 362/487
2005/0285415 A1 12/2005 Metts, IV et al.
2007/0085050 A1 * 4/2007 Scheidler ..... D06M 13/35 252/8.61
2007/0281158 A1 * 12/2007 Glew ..... D02G 3/443 428/375
2008/0223423 A1 * 9/2008 Kupferman ..... A45B 25/18 135/33.7
2012/0211038 A1 * 8/2012 Pirshafiey ..... A47C 21/003 135/96
2013/0258678 A1 * 10/2013 Nichols ..... F21V 11/16 362/351
2013/0306247 A1 * 11/2013 Spurgers ..... E06B 9/24 160/12
2014/0113153 A1 * 4/2014 Afonso ..... B32B 27/08 428/518
2014/0226351 A1 * 8/2014 Hernandez ..... B60J 1/2041 362/509
2014/0305477 A1 * 10/2014 Zemach ..... A45B 3/04 135/33.2
2014/0347724 A1 * 11/2014 Schultz ..... G03B 21/62 359/450
2014/0352747 A1 * 12/2014 Aycan ..... A45B 23/00 135/121
2015/0337593 A1 * 11/2015 Pricone ..... E06B 9/40 160/238
2016/0123034 A1 * 5/2016 Leathers ..... E04H 15/02 135/161
2017/0367448 A1 * 12/2017 Solotoff ..... A45B 25/30

FOREIGN PATENT DOCUMENTS

WO WO-9415508 A1 * 7/1994 ..... A47H 23/06
WO WO-02072972 A1 * 9/2002 ..... A01G 9/222

* cited by examiner

PROJECTOR SUNSHADE COVER

RELATED APPLICATION

This application claims the benefit of priority from U.S. Provisional Patent Application No. 62/163,465 filed May 19, 2015, the contents of which are incorporated herein by reference in their entirety.

FIELD AND BACKGROUND OF THE INVENTION

The present invention, in some embodiments thereof, relates to sunshades and, more particularly, but not exclusively, to a projecting sunshade cover.

Sunshades generally include umbrellas, awnings and other types of canopies which may serve to protect a user or an item from the sun's rays. Frequently, they may also be used to protect from rain. Their covers are generally fabricated from an opaque material which may include a fabric using synthetic materials such as nylon, polyester, and PVC, and which may prevent penetration of UV rays. These materials are generally suitable for printing on them, allowing use of the sunshade for promotional purposes. These types of promotional sunshades may be frequently found in outdoor cafes and restaurants, at beaches, and at many other outdoor locations which may cater to the general public.

In some cases the sunshade cover may be made from a relatively transparent material and may be treated to prevent the penetration of UV through the material. Afonso in US 2014/0113153 discloses "a type of sunshade that has the distinctive feature of allowing sunlight and heat to pass, but prevents the passage of ultraviolet rays. The device, of conventional configuration, has a film consisting of three layers. Each layer consists of copolymers. Additives are added to these layers to absorb and stabilize ultraviolet rays. The invention allows the user, at the beach for example, to sunbathe and feel its warmth, while being protected from the damaging effects of ultraviolet rays".

SUMMARY OF THE INVENTION

There is provided, in accordance with an embodiment of the present invention, a projector sunshade for projecting an image of a logo onto a surface, including a UV-treated sheet, a first area on the UV-treated sheet including a shape of the logo, the first area being substantially transparent to light from an illumination source, and a second area surrounding the first area and including a lower transparency to the light relative to the first area.

There is further provided, in accordance with an embodiment of the present invention, a method of forming a projector sunshade for projecting an image of a logo onto a surface, the method including on a UV-treated sheet, creating a first area including a shape of the logo, the first area substantially transparent to light from an illumination source, and surrounding the first area with a second area including a lower transparency to the light relative to the first area.

There is additionally provided, in accordance with an embodiment of the present invention, a method of projecting an image of a logo onto a surface, the logo formed on a UV-treated sheet, the method including illuminating a first area on the sheet including a shape of the logo, the first area being substantially transparent to light from an illumination source and the first area surrounded by a second area including a lower transparency to the light relative to the first area.

In some embodiments, the illumination source includes solar light.

In some embodiments, the illumination source includes electrical light.

In some embodiments, the second area is on the UV-treated sheet.

In some embodiments, the second area is translucent.

In some embodiments, the second area is opaque.

In some embodiments, the first area includes an inner area with a degree of transparency to the light lower than the first area.

In some embodiments, the UV-treated sheet includes a flexible plastic sheet.

In some embodiments, the UV-treated sheet includes a non-flexible plastic sheet.

In some embodiments, the second area comprises a textile.

In some embodiments, the method further includes creating in said first area an inner area with a degree of transparency to said light lower than said first area.

BRIEF DESCRIPTION OF THE DRAWINGS

Some embodiments of the invention are herein described, by way of example only, with reference to the accompanying drawings. Details shown are for exemplary purposes and serve to provide a discussion of embodiments of the invention. The description and the drawings may be apparent to those skilled in the art how embodiments of the invention may be practiced.

DETAILED DESCRIPTION

Figure 1A:
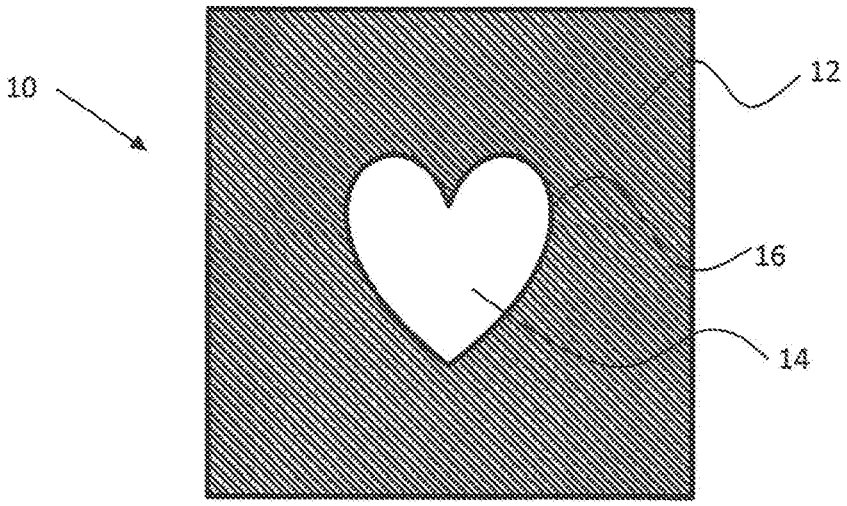
FIG. 1A schematically illustrates a first method of generating a projected image of a logo on a projector sunshade cover, according to an embodiment of the present invention.

Before explaining at least one embodiment of the invention in detail, it is to be understood that the invention is not necessarily limited in its application to the details of construction and the arrangement of the components and/or methods set forth in the following description and/or illustrated in the drawings. The invention is capable of other embodiments or of being practiced or carried out in various ways.

Applicant has realized that present methods used for printing on covers of promotional sunshades are not suitable for a transparent sunshade as described by Afonso as the printing may obstruct the incoming sunlight, thereby reducing the effectivity of using the transparent sunshade. Applicant has further realized that the effectivity of the using the transparent sunshade may be further reduced as a result of the printing interfering with a user's view through the transparent sunshade cover, possibly resulting in user discomfort.

Applicant has therefore realized that the above problems associated with the art may be overcome by using a printing method where the printed item, hereinafter referred to "logo" for convenience, is substantially transparent to not obstruct the incoming light nor to interfere with a user's view through the transparent sunshade cover. The printing method may additionally allow an image of the logo to be projected onto a surface or an object below the transparent sunshade or otherwise located in the vicinity of the sunshade as the sun's light passes through the printing.

The ability to project the image, Applicant has further realized, may be implemented in a projector sunshade which not only displays the logo on the sunshade cover itself, but also exhibits the logo in a projected image onto a surface or object. The sunshade cover may be partially transparent or translucent, or alternatively opaque, with the logo being substantially transparent to allow sunlight to pass through to generate the projected image. Alternatively, the logo may be formed using a negative printing technique to allow the sunlight to pass through and generate the projected image. The result is an advertising apparatus which increases exposure to advertising content by effectively multiplying the display area through the projected image. It may be appreciated that advertising using this type of sunshade may be more effective than existing promotional sunshades which only display the logo. It may be further appreciated that a sunshade cover that allows projecting the logo onto a surface or an object may be used in applications other than advertising, for example, for decorative purposes in private residences as well as in commercial and public facilities.

In an embodiment of the present invention, the printing method may include digital printing to print onto a UV-treated transparent plastic sheet which may be used to form the projector sunshade cover or a section of the cover. The UV filtering may range from 0%-99%, although preferably around 90%, for example, 80%, 82%, 86%, 89%, 90%, 92%, 94%, 95%. The plastic material may include any suitable flexible plastic which may be printed on such as, for example, PVC, Polyethylene, and Polypropylene. Depending on the application, the plastic material may be non-flexible and may include use of polycarbonates (e.g. in structures). The size of the ink drops may range from 0-60 Pico liters or greater, for example 30 Pico liters. Ink coverage may range from 10-100%, depending on the degree of shading required surrounding the projected image or images, for example, 75%. A preferable thickness of the ink coat layer may range from 10-50 microns, although other thicknesses may be possible. In some embodiments of the present invention, the printing method may include using flexographic printing. The flexographic printing may apply one or more coating of ink depending on the degree of shading and the color of the shading required for the projector shading cover and optionally for the projected image when the logo is formed using negative print technique, for example, 3 coatings. In some embodiments of the present invention, the printing method may include silk screen printing. The logo may include letters, number, figures, symbols, colors, patterns, or any combination thereof. The printing may be applied to a side of the transparent plastic which will not be directly exposed to the UV radiation from the sun when used as the sunshade cover, for example, to the underside of the transparent plastic.

In an embodiment of the present invention, fabrication of the projector sunshade cover may include first producing the shape of the cover, followed by the logo to create the projecting plastic cover. Alternatively, the logo may first be done followed by forming of the cover. The cover may be produced in a single plastic sheet or may be produced in sections which may be attached to form the projecting sunshade cover. The attachment of the sections may be done using known methods such as plastic sheet welding or single or multiple stitching (e.g. double stitching). In some embodiments, the cover or sections of the cover may be manufactured from textile or other opaque material, and the logo may be formed using a negative printing technique by cutting out the shape of the logo from the opaque material. UV-treated transparent plastic may then be attached to the cut out section of the opaque material.

In an embodiment of the present invention, the projector sunshade cover may be used with an umbrella. In some embodiments, the projector sunshade cover may be used with an awning, a canopy, and other large or small structures suitable to allow the cover to be positioned vertically, horizontally, or at an angle. In some embodiments, the projector sunshade cover may be used with any type of item on which it may be functionally installed or to which it may be functionally attached, and may include, for example, outdoor furniture, including chairs and tables. In some embodiments, functionality of the projection sunshade cover may not be limited to outdoor daytime use and may be used indoors or outdoors under illumination. In some embodiments, illumination may be placed under the projection sunshade cover and may allow projecting of the logo in an upwards direction above the cover.

Reference is now made to FIG. 1A which schematically illustrates a first method of generating a projected image of a logo 16 on a projector sunshade cover 10, according to an embodiment of the present invention. Sunshade cover 10 may include a background area 12 and a logo area 14.

Background area 12 and logo area 14 may be formed from a UV-treated plastic sheet, which may be the same sheet or sections from different sheets which may be attached together. Background area 12 may be printed with an amount of ink to achieve a degree of transparency different from that of logo area 14. Optionally, background area 12 may be translucent. Ink printing may include use of digital printing techniques, flexographic printing techniques, or silk screen printing techniques.

In some embodiments, logo area 14 may include an amount of ink, or optionally none at all, so that the area is substantially transparent to allow the sun to pass through and project an image of logo 16. In some embodiments, logo area 14 may be formed with ink of a different color than that used for background area 12 to allow the projected image to have a different color from that which may be projected by the background area. In some embodiments, background area 12 may be opaque. In some embodiments, background area may include a textile or other non-plastic material, and logo 16 may be formed by cutting the logo area 14 onto the textile or other non-plastic material and covering the logo area with a UV-treated plastic.

Figure 1B:
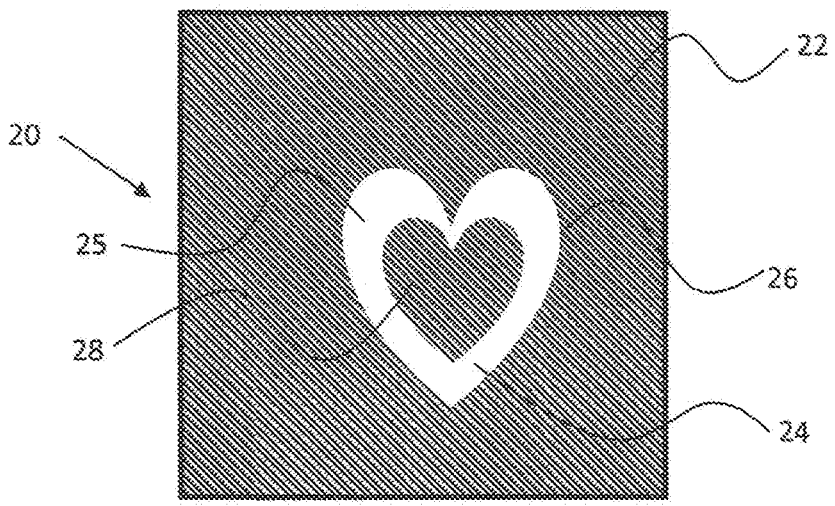
FIG. 1B schematically illustrates a second method of generating a projected image of a logo on a projector sunshade cover and which includes us of a negative printing technique, according to an embodiment of the present invention.

Reference is now made to FIG. 1B which schematically illustrates a second method of generating a projected image of a logo 26 on a projector sunshade cover 20 and which includes use of a negative printing technique, according to an embodiment of the present invention. Sunshade cover 20 may include a background area 22 and a logo area 24.

Background area 22 and logo area 24 may be substantially similar to background area 12 and logo area 14 shown in FIG. 1.A, with the exception that logo area includes an inner area 28 which may be formed with an amount of ink which may be similar to that of the background area, and may optionally be translucent. Alternatively, the amount and/or color of inner area 28 may be different than that of background area 22.

In some embodiments, the inclusion of inner area 28 may allow the sun to pass through a frame 25 formed between background area 22 and the inner area. In this case, inner area 28 may cast a shadow and the projected image of logo 26 may include the shadow. The projected image of logo 26 may be in contrast with the method of FIG. 1A where the projected image of logo 16 is substantially of all the light passing through logo area 14.

Figure 2:
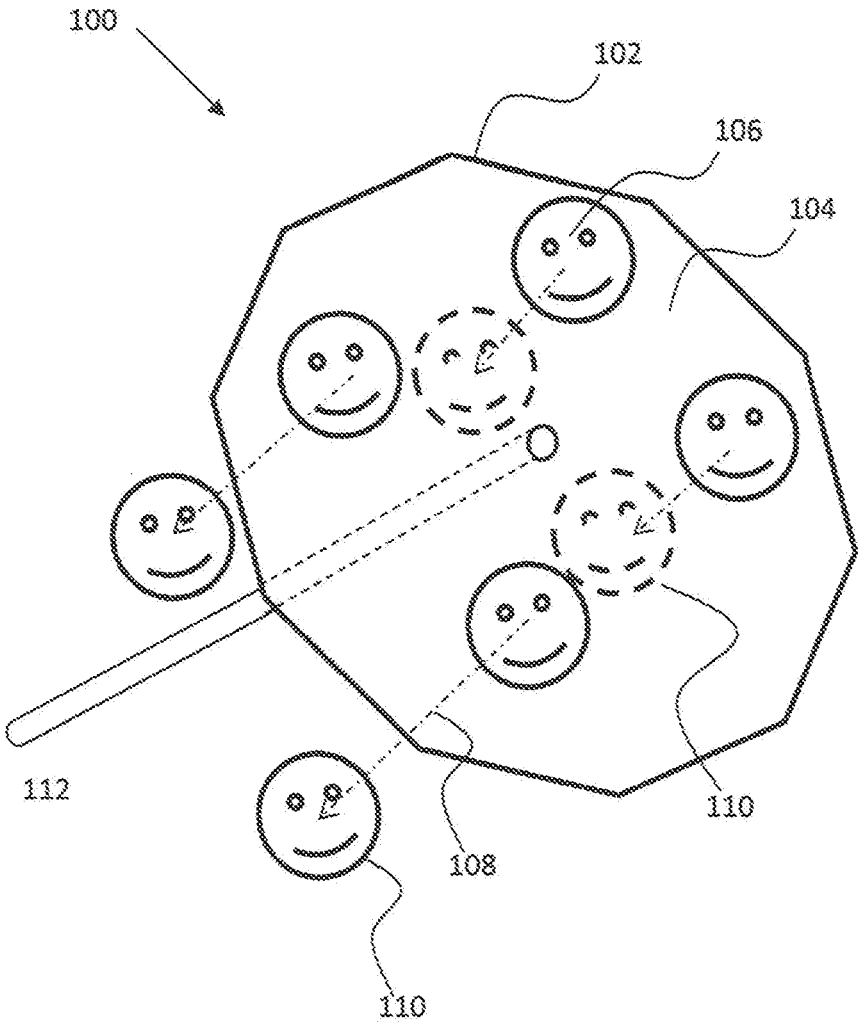
FIG. 2 schematically illustrates a projector sunshade cover used on an umbrella, according to an embodiment of the present invention.

Reference is now made to FIG. 2 which schematically illustrates a projector sunshade cover 102 used on an umbrella 100, according to an embodiment of the present invention. Umbrella 100 may be any type of umbrella, and may include a beach umbrella, a pool umbrella, and a cafe/restaurant umbrella, among many other types of umbrellas. Sunshade cover 102 may include a background area 104 and a plurality of logo areas 106.

Logo areas 106 may allow the sun rays, shown by arrows 108, to pass through and to project images 110 of the logos on ground 112. Any of the methods described with reference to FIGS. 1A and 1B may be used to generate images 110.

Figure 3:
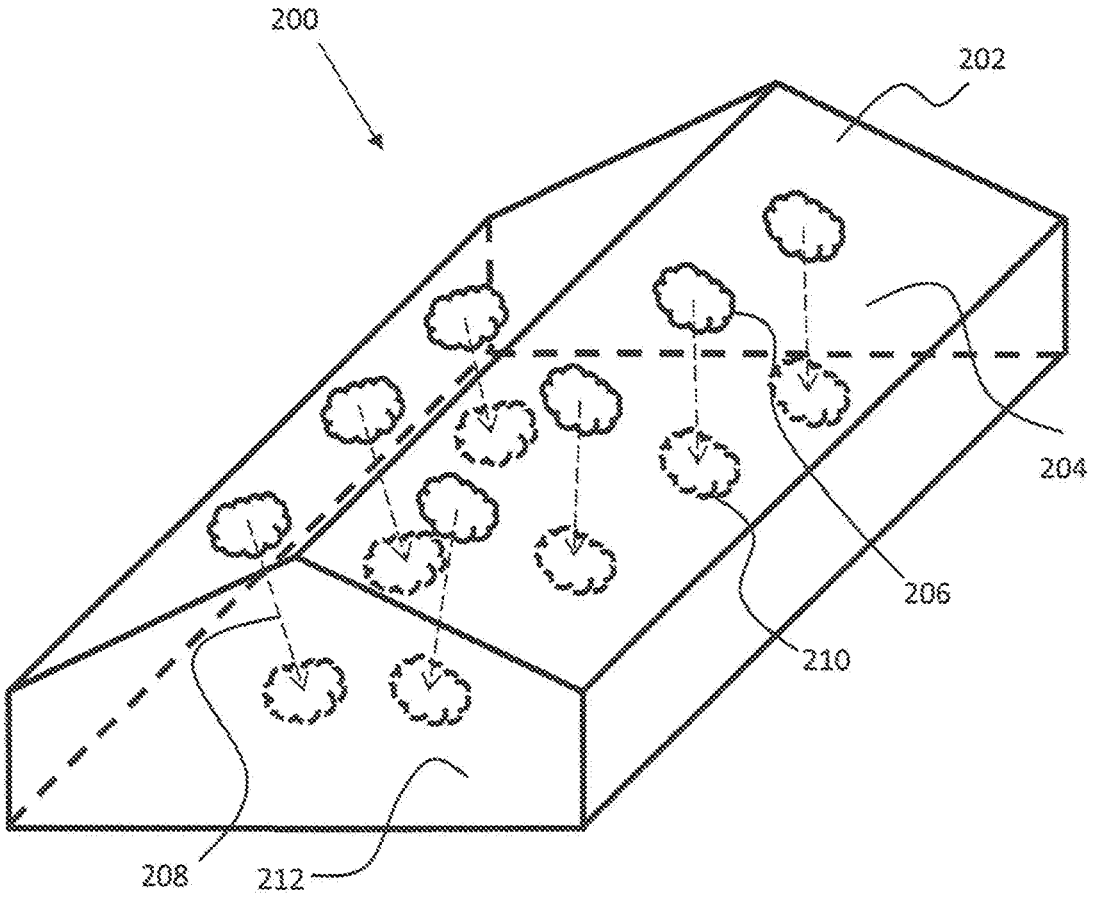
FIG. 3 schematically illustrates a projector sunshade cover used on a large structure, according to an embodiment of the present invention.

Reference is now made to FIG. 3 which schematically illustrates a projector sunshade cover 202 used on a large structure 200, according to an embodiment of the present invention. Large structure 200 may include structures used for theaters, banquet halls, restaurants, among many types of large structures. Sunshade cover 202 may include a background area 204 and a plurality of logo areas 206.

Logo areas 206 may allow the sun rays, shown by arrows 208, to pass through and to project images 210 of the logos on ground 212. Any of the methods described with reference to FIGS. 1A and 1B may be used to generate images 110.

Figure 4:
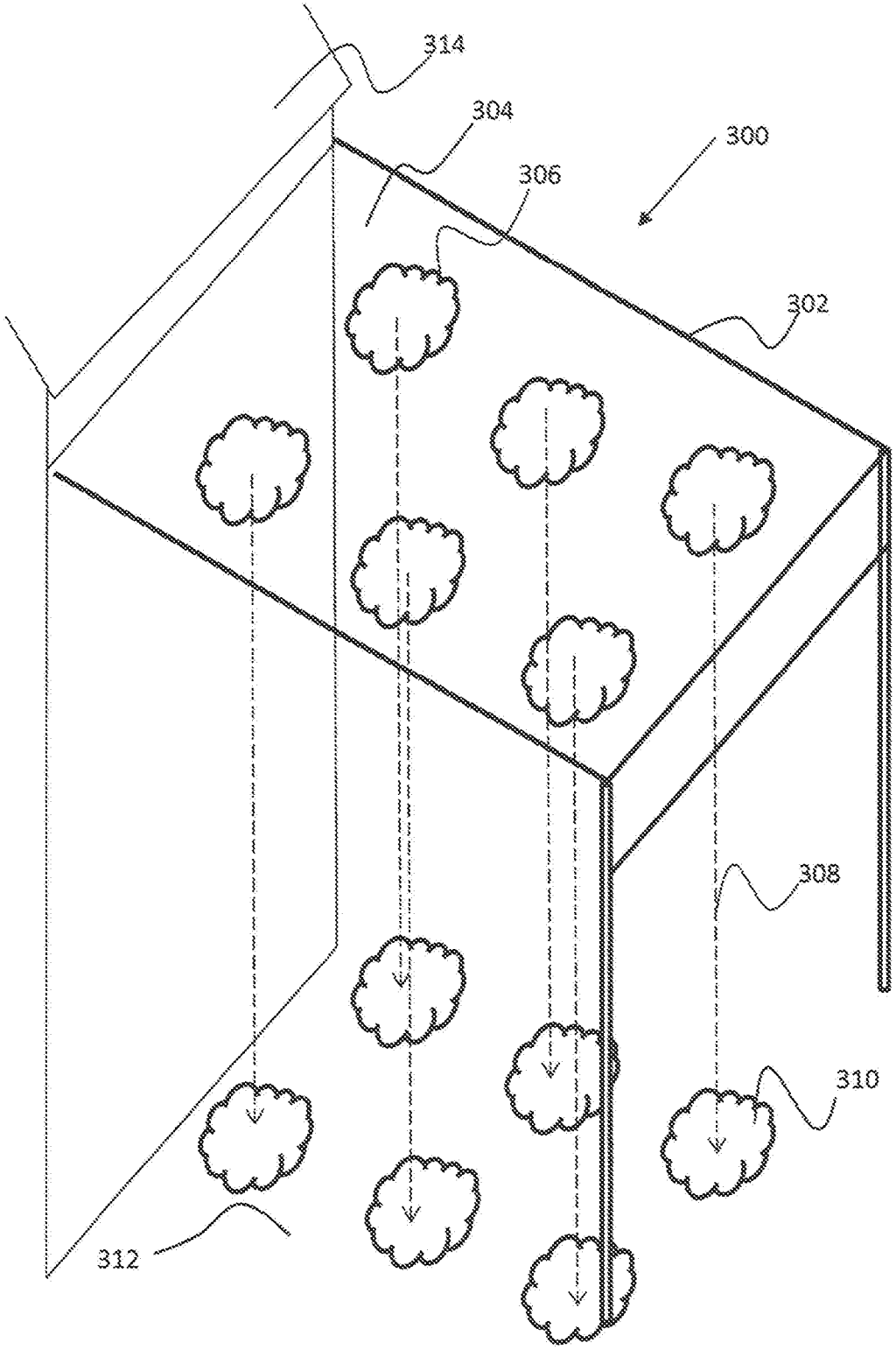
FIG. 4 schematically illustrates a projector sunshade cover used on an awning, according to an embodiment of the present invention.

Reference is now made to FIG. 4 which schematically illustrates a projector sunshade cover 302 used on an awning 300, according to an embodiment of the present invention. Awning 300 may be attached to a structure 314, for example a house. Sunshade cover 302 may include a background area 304 and a plurality of logo areas 306.

Logo areas 306 may allow the sun rays, shown by arrows 308, to pass through and to project images 310 of the logos on ground 312. Any of the methods described with reference to FIGS. 1A and 1B may be used to generate images 110.

Figure 5:
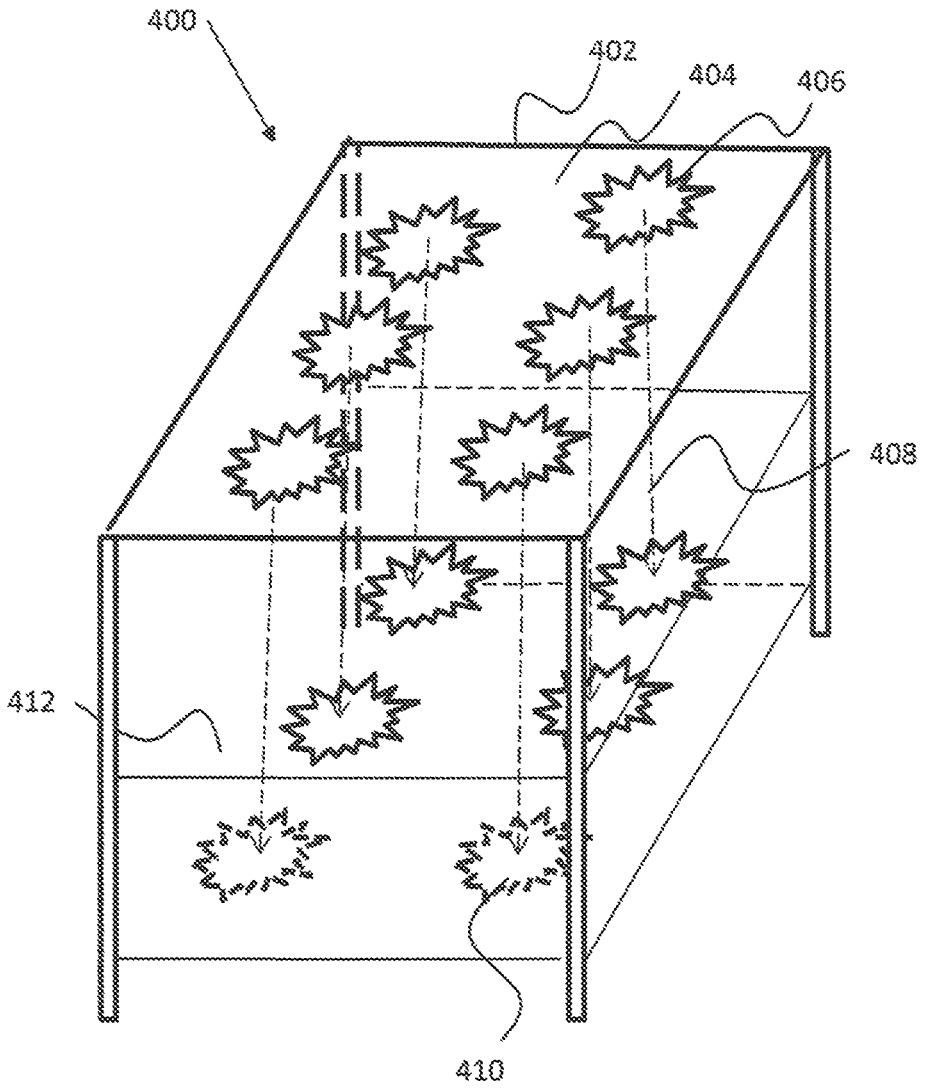
FIG. 5 schematically illustrates a projector sunshade cover used on a canopy, according to an embodiment of the present invention.

Reference is now made to FIG. 5 which schematically illustrates a projector sunshade cover 402 used on a canopy 400, according to an embodiment of the present invention. Canopy 400 may be self-standing. Sunshade cover 402 may include a background area 404 and a plurality of logo areas 406.

Logo areas 406 may allow the sun rays, shown by arrows 408, to pass through and to project images 410 of the logos on ground 412. Any of the methods described with reference to FIGS. 1A and 1B may be used to generate images 110.

Figure 6:
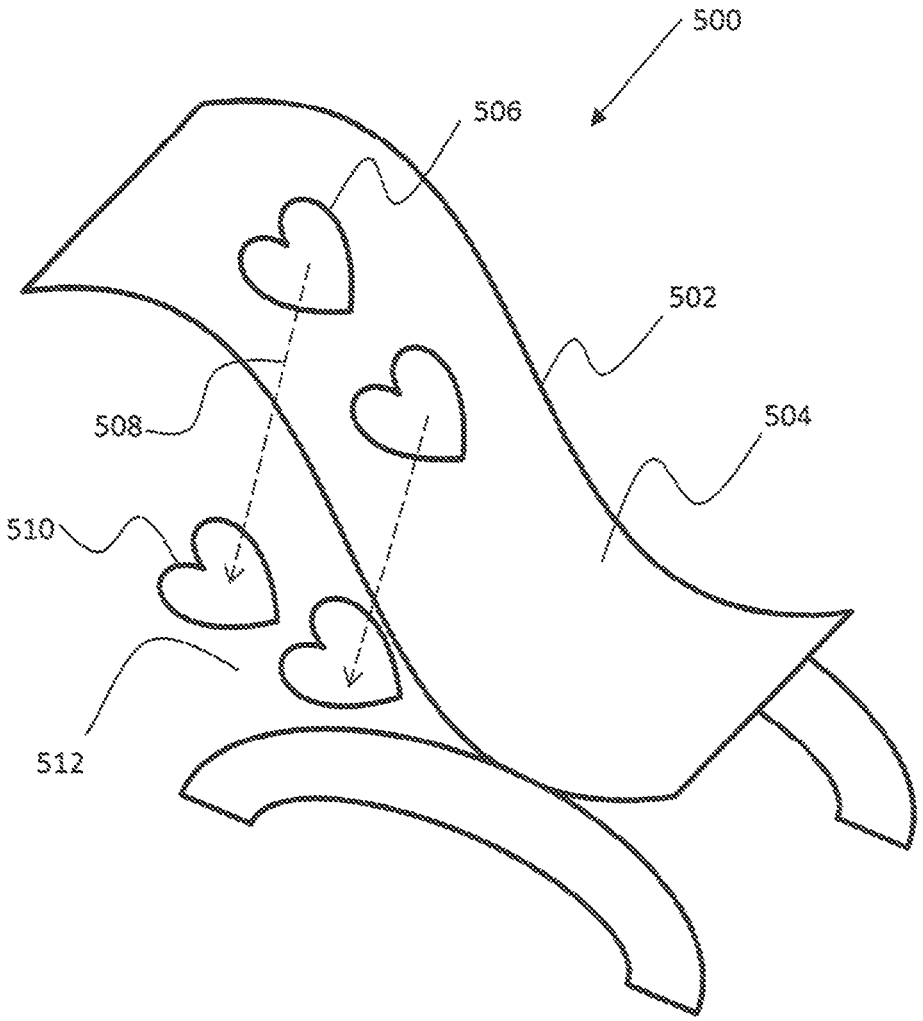
FIG. 6 schematically illustrates a projector sunshade cover used on a leisure chair, according to an embodiment of the present invention.

Reference is now made to FIG. 6 which schematically illustrates a projector sunshade cover 502 used on a chair 500, according to an embodiment of the present invention. Chair 500 may be an indoor chair or an outdoor chair, and may include beach chairs, pools chairs, garden chairs, park benches, among many other types of chairs, seats, benches, and the like. Sunshade cover 502 may include a background area 504 and a plurality of logo areas 506.

Logo areas 506 may allow the sun rays, shown by arrows 508, to pass through and to project images 510 of the logos on ground 512. Any of the methods described with reference to FIGS. 1A and 1B may be used to generate images 110.

Figure 7:
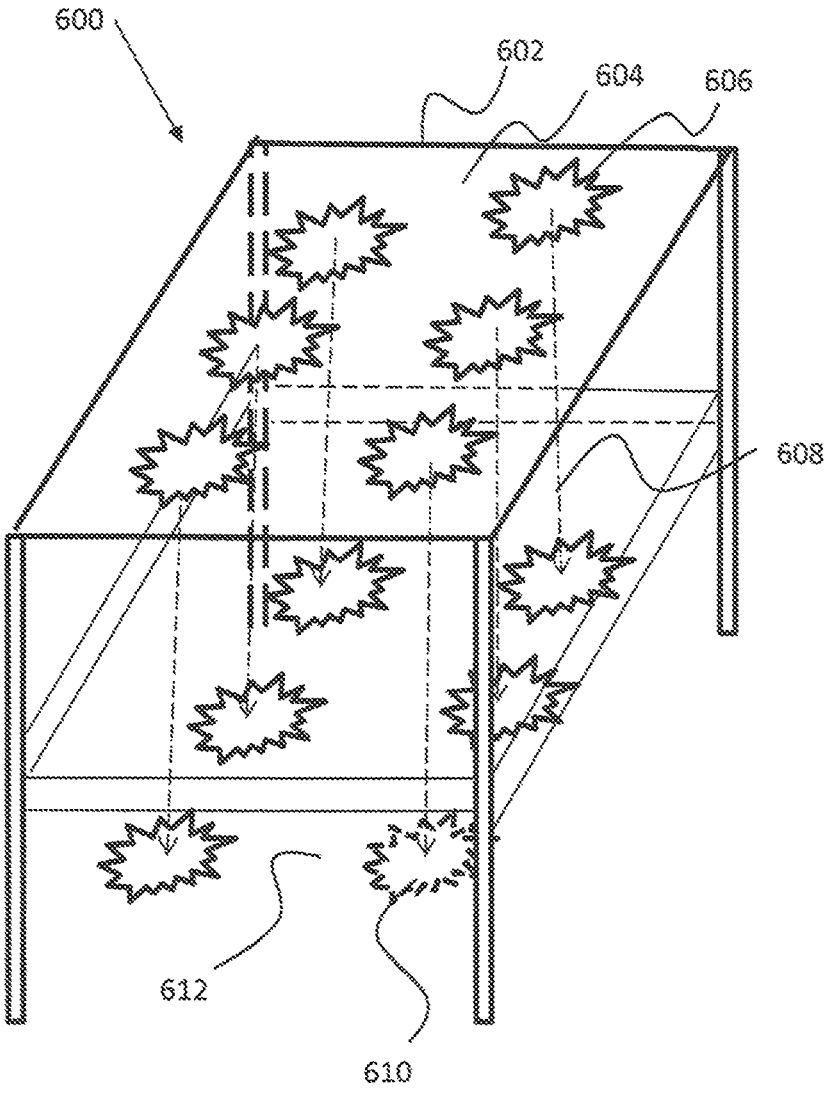
FIG. 7 schematically illustrates a projector sunshade cover used on a table, according to an embodiment of the present invention.

Reference is now made to FIG. 7 which schematically illustrates a projector sunshade cover 602 used on a table 600, according to an embodiment of the present invention. Table 600 may include any type of table which may include a hardened top, for example, as may be produced using polycarbonates among other type of hard plastics. Sunshade cover 602 may include a background area 604 and a plurality of logo areas 606.

Logo areas 606 may allow the sun rays, shown by arrows 608, to pass through and to project images 610 of the logos on ground 612. Any of the methods described with reference to FIGS. 1A and 1B may be used to generate images 110.

Figure 8:
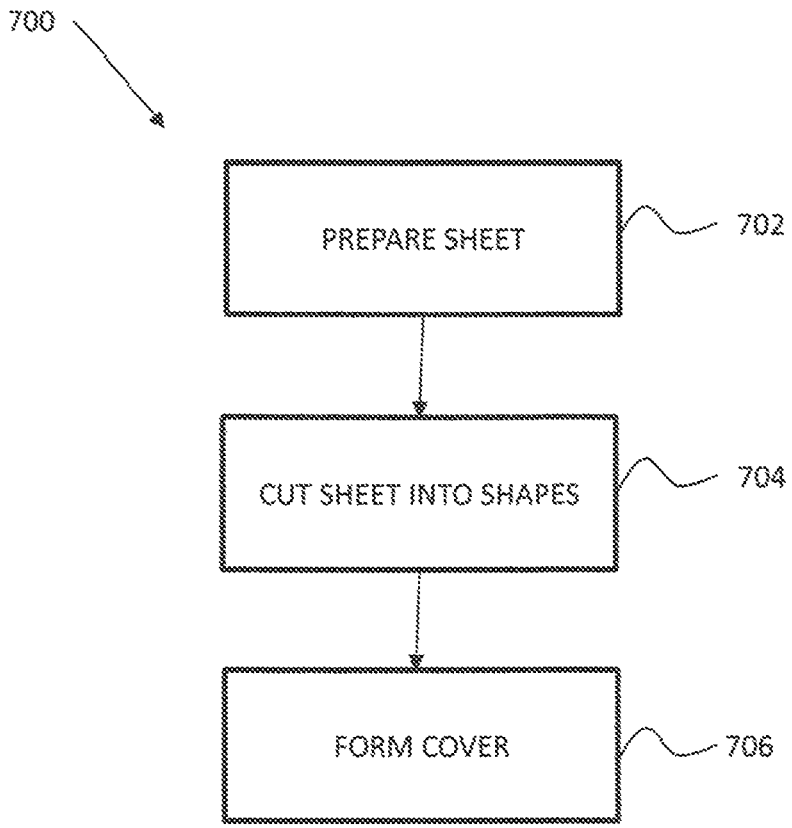
FIG. 8 is a flow chart of an exemplary method of producing a projector sunshade cover, according to an embodiment of the present invention.

Reference is now made to FIG. 8 which shows a flow chart of an exemplary method 700 of producing a projector sunshade cover, according to an embodiment of the present invention. The method described is for exemplary purposes and the skilled person may appreciate that the method may be practiced with more or less steps, or with a different sequence of steps.

At 702, a UV-treated plastic sheet is printed on to prepare the background area and the logo area using any one of digital printing or flexographic printing. The background area and the logo area may be prepared as described with reference to FIGS. 1A and 1B. Alternatively, all or part of the background area may include a non-plastic sheet, for example, a textile.

At 704, the sheet is cut into shapes to suit the type of projector sunshade cover which is to be prepared. Alternatively, the sheet is not cut into shapes depending on the sunshade cover which is to be formed.

At 706, the projector sunshade cover is formed. The cut sheets may be attached using techniques known in the art and which may include plastic sheet welding or single or multiple stitching (e.g. double stitching), or other techniques according to the type of UV-treated sheet.

In some embodiments, for silk screen printing, steps 702 and 704 are interchanged.

The foregoing description and illustrations of the embodiments of the invention has been presented for the purposes of illustration. It is not intended to be exhaustive or to limit the invention to the above description in any form.

Any term that has been defined above and used in the claims, should to be interpreted according to this definition.

The invention claimed is:

1. A sunshade comprising:

a canopy comprising a flexible plastic sheet;

a first area on said plastic sheet comprising a printed shape of a logo, said first area comprising a material substantially transparent to impinging light and suitable to project an image of said logo onto a surface or object distantly located from said canopy; and a second area on said plastic sheet surrounding said first area and comprising a material having a lower transparency to said light relative to said first area.

2. A sunshade according to claim 1 wherein said canopy is an umbrella canopy, an awning canopy, or a canopy on a structure.

3. A sunshade according to claim 1 wherein impinging light comprises electrical light or solar light.

4. A sunshade according to claim 1 wherein said first area and said second area are on an underside of said plastic sheet.

5. A sunshade according to claim 1 where said second area is translucent.

6. A sunshade according to claim 1 wherein said second area is opaque.

7. A sunshade according to claim 1 wherein said printed shape comprises a digitally printed shape, a flexographic printed shape, or a silk screen printed shape.

8. A method of forming a sunshade the method comprising:

on a flexible plastic sheet; creating a first area comprising a printed shape of a logo, said first area comprising a material substantially transparent to impinging light and suitable to project an image of said logo onto a surface or object distantly located from said plastic sheet;

on said plastic sheet, surrounding said first area with a second area comprising a material having a lower transparency to said light relative to said first area; and forming a canopy from said flexible plastic sheet.

9. A method according to claim 8 wherein said canopy is an umbrella canopy, an awning canopy, or a canopy on a structure.

10. A method according to claim 8 wherein said impinging light comprises electrical light or solar light.

11. A method according to claim 8 wherein said first area and said second area are on an underside of said plastic sheet.

12. A method according to claim 8 where said second area is translucent.

13. A method according to claim 8 wherein said second area is opaque.

14. A method according to claim 8 wherein said printed shape comprises a digitally printed shape, a flexographic printed shape, or a silk screen printed shape.

15. A method of projecting an image of a logo on a sunshade, the method comprising:

on a canopy comprising a flexible plastic sheet, illuminating a first area on said plastic sheet comprising a printed shape of the logo, said first area comprising a material substantially transparent to impinging light and suitable to project an image of the logo onto a surface or object distantly located from said canopy, said first area surrounded by a second area comprising a material having a lower transparency to said light relative to said first area.

16. A method according to claim 15 wherein said canopy is an umbrella canopy, an awning canopy, or a canopy on a structure.

17. A method according to claim 15 wherein said impinging light comprises electrical light or solar light.

18. A method according to claim 15 wherein said first area and said second area are on an underside of the plastic sheet.

19. A method according to claim 15 where said second area is translucent.

20. A method according to claim 15 wherein said second area is opaque.

* * * * *